US005975961A

United States Patent [19]

Atsumi et al.

[11] Patent Number: 5,975,961

[45] Date of Patent: Nov. 2, 1999

[54] BLOCK CONNECTOR

[75] Inventors: Keigo Atsumi; Masahiko Aoyama; Hitoshi Okumura; Mitsugu Furutani, all of Yokkaichi, Japan

[73] Assignee: Sumitomo Wiring Systems, Ltd., Japan

[21] Appl. No.: 08/967,709

[22] Filed: Nov. 10, 1997

[30] Foreign Application Priority Data

Nov. 12, 1996 [JP] Japan ..... 8-300647

[51] Int. Cl.[6] ..... H01R 13/514

[52] U.S. Cl. ..... 439/701

[58] Field of Search ..... 439/701, 717, 439/709, 752.5, 354

[56] References Cited

U.S. PATENT DOCUMENTS

| | | | |
|---|---|---|---|
| 5,122,077 | 6/1992 | Maejima et al. | 439/398 |
| 5,288,251 | 2/1994 | Sumida | 439/701 |
| 5,320,555 | 6/1994 | Okabe | 439/354 |

FOREIGN PATENT DOCUMENTS

| | | |
|---|---|---|
| 0 470 887 | 2/1992 | European Pat. Off. . |
| 0 600 602 | 6/1994 | European Pat. Off. . |
| 2 271 681 | 12/1975 | France . |

*Primary Examiner*—Steven L. Stephan
*Assistant Examiner*—Eugene G. Byrd
*Attorney, Agent, or Firm*—Anthony J. Casella; Gerald E. Hespos

[57] ABSTRACT

To prevent the disengagement of housings by a simple construction, four projections 14 stand on the upper surface of a lower housing 1, and round holes 14 into which the corresponding projections 14 are fitted are formed in the lower surface of the upper housing 2. The end face of each projection 14 is bevelled to form a tapered guide surface 15. When the upper housing 2 is placed on the lower housing 1, the housings 1, 2 are locked by the lock portions 5, and the projections 14 and the round holes 16 provided on the surfaces of the housings 1, 2, which come together are engaged in four positions. In this way, the relative rotation of the housings 1, 2 is prevented and such a force as to elastically deform the lock portions 5 does not act. The projections 14 and the round holes 16 are engaged with each other by being guided by the guide surfaces 15, thereby easily positioning the housings 1, 2. Thus, the housings 1, 2 can be smoothly placed one over the other.

12 Claims, 6 Drawing Sheets

BLOCK CONNECTOR

BACKGROUND OF THE INVENTION

1. Field of the Invention

The present invention relates to a block connector.

2. Description of the Prior Art

A prior art block connector has either male or female connectors and is constructed by placing a plurality of connector housings one over another. Specifically, as shown in FIG. 7, a prior art block connector is comprised of a lower housing "a" and an upper housing "b". Lock portions "d" each are formed with a lock hole "c" and stand on four corners of the upper surface of the lower housing "a". The upper housing "b" is formed with lock projections "e" that are engageable with the lock holes "c". The upper housing "b" is placed on the lower housing "a" while elastically deforming the respective lock portions "d" outwardly. When the lock portions "d" are elastically restored to their original positions, the lock projections "e" are fitted into the lock hole "c", with the result that the housings "a" and "b" are locked while being placed one over the other (see FIG. 8).

In the prior art block connector described above, particularly the one having a small housing, the formed lock portions "d" can have only a small thickness. In such a case, the lock portions "d" can satisfactorily function to prevent the disengagement of the housings "a" and "b". However, if, for example, a force acts on the housings "a" or "b" so as to displace them or a rotational force acts on the housings "a" or "b" as indicated by arrows in FIG. 8, the lock portions "d" may be elastically deformed, thereby disengaging the housings "a" and "b".

The present invention was developed in view of the above problem and an object thereof is to prevent the disengagement of housings by a simple construction.

SUMMARY OF THE INVENTION

According to the invention, there is provided a block connector constructed by placing a plurality of connector housings one over another. The connector housings are locked by lock portions provided on at least one of the connector housings. At least one of the lock portions preferably is elastic. A lock portion on one connector housing may be placed over a lock portion on the other connector housing. At least one projected portion and at least one recess, which are engageable or fittable or mating with each other, are provided on surfaces of the connector housings which come together or are facing each other in the assembled state.

When one connector housing is placed on the other connector housing, the two connector housings are locked by the lock portions, and the projected portion and the recess provided on the surfaces of the housings which come together are engaged. Accordingly, the connector housings are unlikely to be displaced from each other or to be rotated with respect to each other, thereby preventing the action of such a force as to elastically deform the lock portions. In other words, the connector housings can be firmly locked only by a simple construction in which the projected portion and the recess are provided on the surfaces which come together.

According to a preferred embodiment of the invention, at least one of the projected portion and the recess is provided with a guide portion for guiding the engagement of the projected portion and the recess. The corresponding projected portion and recess are engaged with each other while being guided by the guide portion. Thus, the connector housings can be smoothly placed one over the other.

Preferably, the projected portion and the recess start engaging prior to the locking by the lock portions. Thus, the projected portion and the recess function to position the two connector housings, and the assembling of the connector housing including the locking by the lock portions can be more smoothly performed.

Further preferably, the projected portion and the recess are formed to have a noncircular cross section. If the projected portion and the recess have a noncircular cross section, the relative rotation of the connector housings can be prevented by providing the projected portion and the recess in at least one position.

Further preferably, the lock portions are elastically locking the connector housings, the lock portions being preferably unitarily or integrally formed on at least one of the connector housings.

Still further preferably, there are provided at least two projected portions having different shapes from each other. Accordingly a rotational inversion of the two connector housings to be placed one over another (i.e. a rotation of one connector housing with respect to a connector housing in particular by 180° about an axis normal thereto) is not possible or is avoided.

Most preferably, there are at least two projected portions which are provided in positions which are not rotationally symmetrical or inverted. Accordingly a rotational inversion of the two connector housings to be placed one over another is not possible or is avoided.

These and other objects, features and advantages of the present invention will become more apparent upon a reading of the following detailed description and accompanying drawings.

DETAILED DESCRIPTION OF THE PREFERRED EMBODIMENTS

Figure 1:
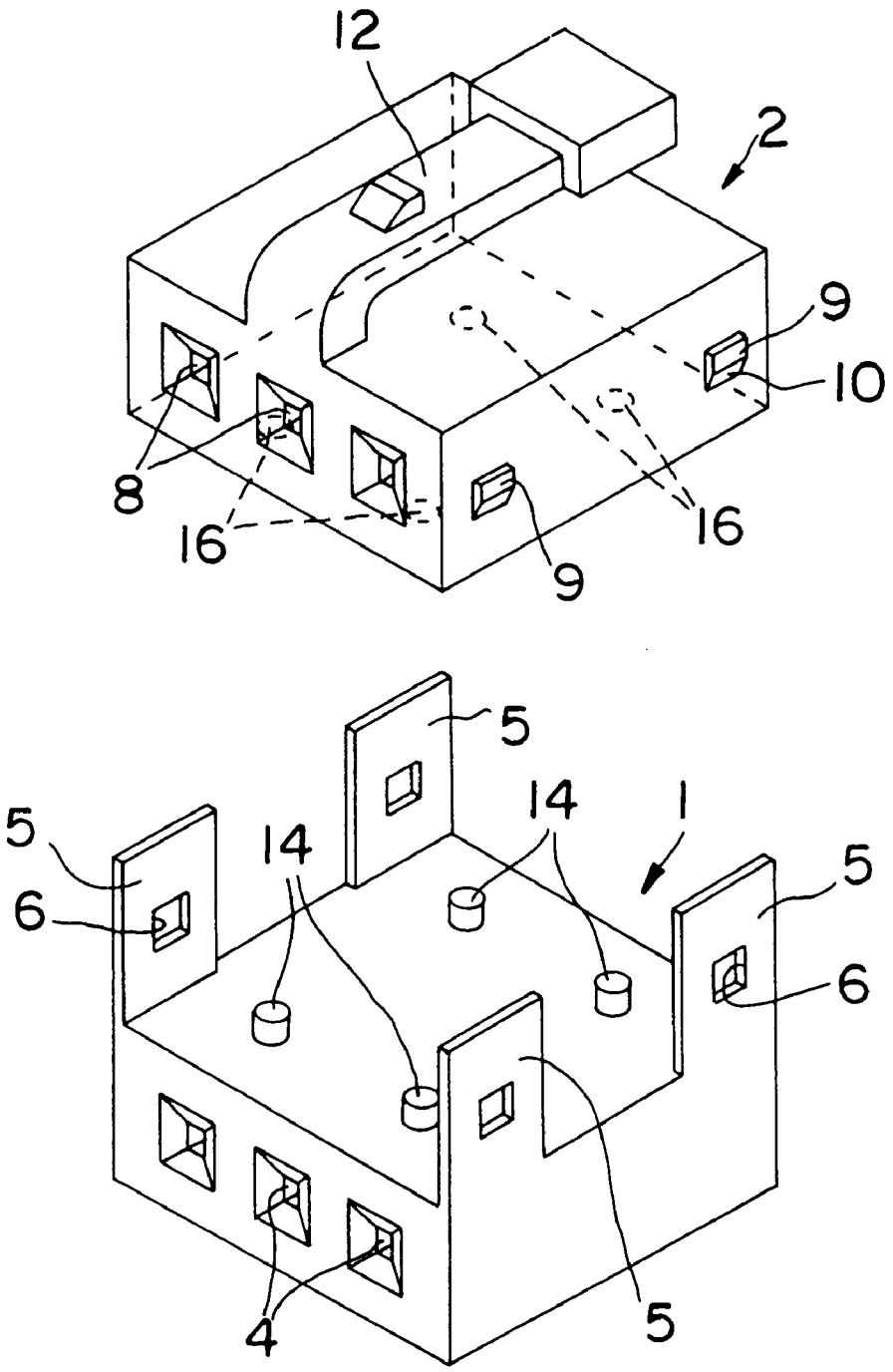
FIG. 1 is a perspective view of a first embodiment of the invention before being assembled.

FIGS. 1 to 4 show a first embodiment of the invention. In this embodiment, a female block connector having a lower housing 1 and an upper housing 2 is shown.

The lower housing 1 is made, for example, of a synthetic resin and has a shape of a substantially flat substantially rectangular parallelepiped. Inside the lower housing 1, three cavities 4 for accommodating unillustrated female terminal fittings are arranged side by side. On the upper surface of the lower housing 1, four lock portions 5 each formed with a lock hole 6 stand preferably at front and rear ends of left and right sides. Of course, the number and location of cavities 4 and the number and location lock portions 5 may be different on other embodiments.

The upper housing 2 is likewise made e.g. of a synthetic resin and has a shape of a substantially flat substantially rectangular parallelepiped. Inside the upper housing 2, three cavities 8 similar to the cavities 4 are arranged side by side. The upper housing 2 is formed to have a slightly smaller width than the lower housing 1 so as to be placed or placeable on the upper surface of the lower housing 1 while being fitted between the left and right lock portions 5. Lock projections 9 engageable with the lock holes 6 of the lock portions 5 are formed at portions of the upper housing 2 corresponding to the lock holes 6, preferably at front and rear ends of the left and right side surfaces of the upper housing 2. The lower surface of each lock projection 9 is a tapered surface 10. On the surface opposite to the lower housing 1, preferably on the upper surface of the upper housing 2 is formed a lock arm 12 for locking this female block connector with an unillustrated mating male connector.

Figure 2:
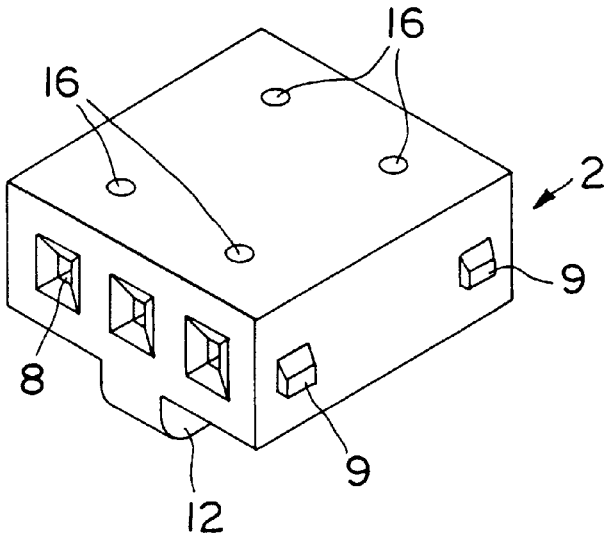
FIG. 2 is a perspective view of the upper housing in its vertically inverted position.
Figure 3:
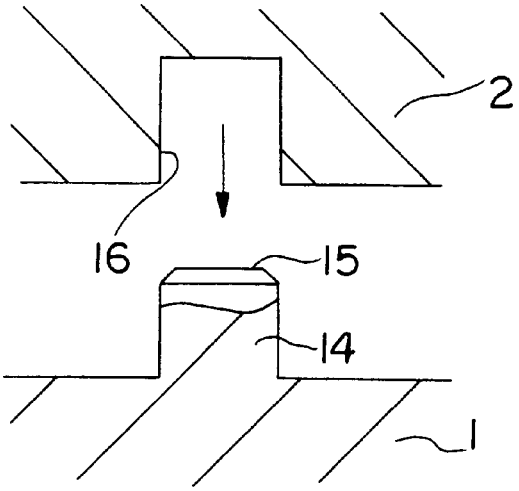
FIG. 3 is an enlarged section of a projection and a round hole.

On the upper surface of the lower housing 1 are formed e.g. four preferably cylindrical projections 14 in positions preferably at a distance from the center of the connector housing, and preferably in corner positions of substantially a rectangle. On the lower surface of the upper housing 2 are, as shown in FIGS. 2 and 3, formed a corresponding number of mating holes 16, e.g. four round holes 16 having substantially the same diameter and the same arrangement as the projections 14. The end face of each projection 14 is bevelled to form a tapered guide surface 15.

The action of the thus constructed embodiment is described herebelow.

The housings 1 and 2 are separately formed. The block connector is assembled as follows. After female terminal fittings are accommodated in the cavities 4, 8 of the respective housings 1, 2, the upper housing 2 is placed on the lower housing 1. The upper housing 2 is pressed while elastically deforming the respective lock portions 5 outward by the contact of the tapered surfaces 10 of the respective lock projections 9 with the upper ends of the lock portions 5. Immediately before the upper housing 2 is placed on the lower housing 1, the guide surfaces 15 of the projections 14 of the lower housing 1 face the opening edges of the corresponding round holes 16 of the upper housing 2. If the lower and upper housings 1, 2 are displaced from each other, they are positioned by being guided by the guide surfaces 15, and the projections 14 are fitted into the round holes 16.

Figure 4:
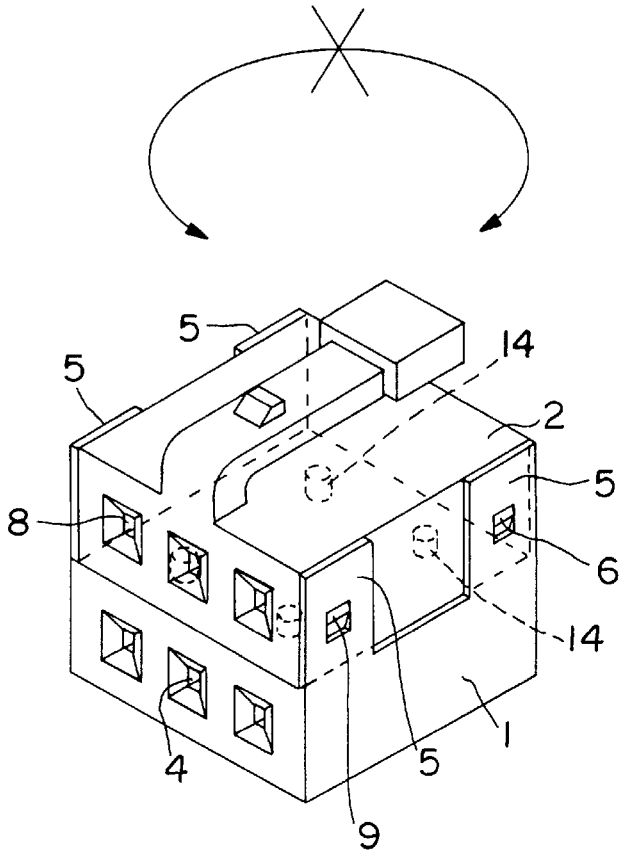
FIG. 4 is a perspective view of the housings in their assembled states.

When the upper housing 2 is completely placed, the lock projections 9 substantially face the lock holes 6 of the lock portions 5 as shown in FIG. 4. Accordingly, the lock projections 9 are fitted or inserted into the lock holes 6 while the lock portions 5 are elastically restored to their original positions, with the result that the housings 1 and 2 are disengageably locked. Since the four projections 14 provided on the upper surface of the lower housing 1 are fitted into the corresponding round holes 16 formed in the lower surface of the upper housing 2, a rotational movement of the housings 1, 2 is prevented and no such force to elastically deform the lock portions 5 acts. Of course, the displacement of the housings 1, 2 is also prevented.

According to this embodiment, the housings 1, 2 can be firmly locked by a simple construction in which the projections 14 are provided on the upper surface of the lower housing 1 and the round holes 16 are provided in the lower surface of the upper housing 2. Further, by providing the guide surfaces 15 on the projections 14, the lower and upper housings 1, 2 are positioned before being locked by the respective lock portions 5, and the block connector can be more smoothly assembled.

Figure 5:
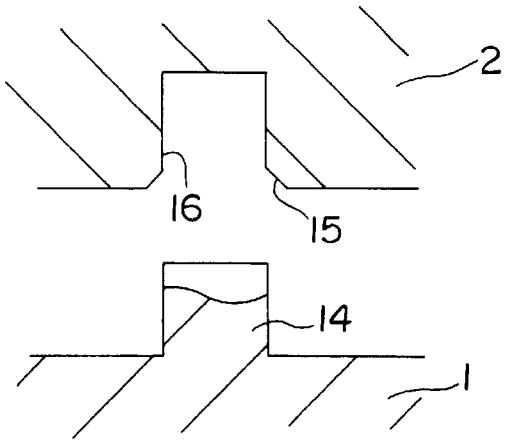
FIG. 5 is a partially enlarged section of a second embodiment.

In a second embodiment shown in FIG. 5, the guide surfaces 15 for positioning the lower and upper housings 1 and 2 are formed at the opening edges of the round holes 16. The guide surfaces 15 may be provided on both the projections 14 and the round holes 16.

Figure 6:
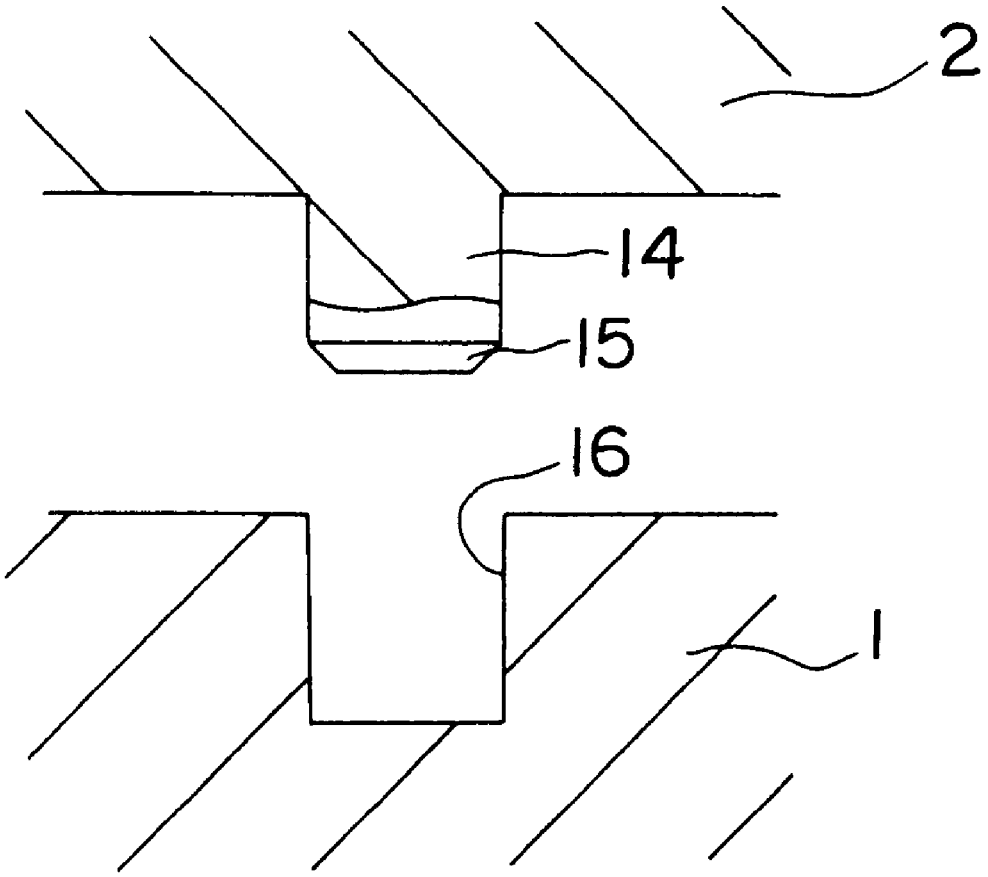
FIG. 6 is a partially enlarged section of a third embodiment.
Figure 7:
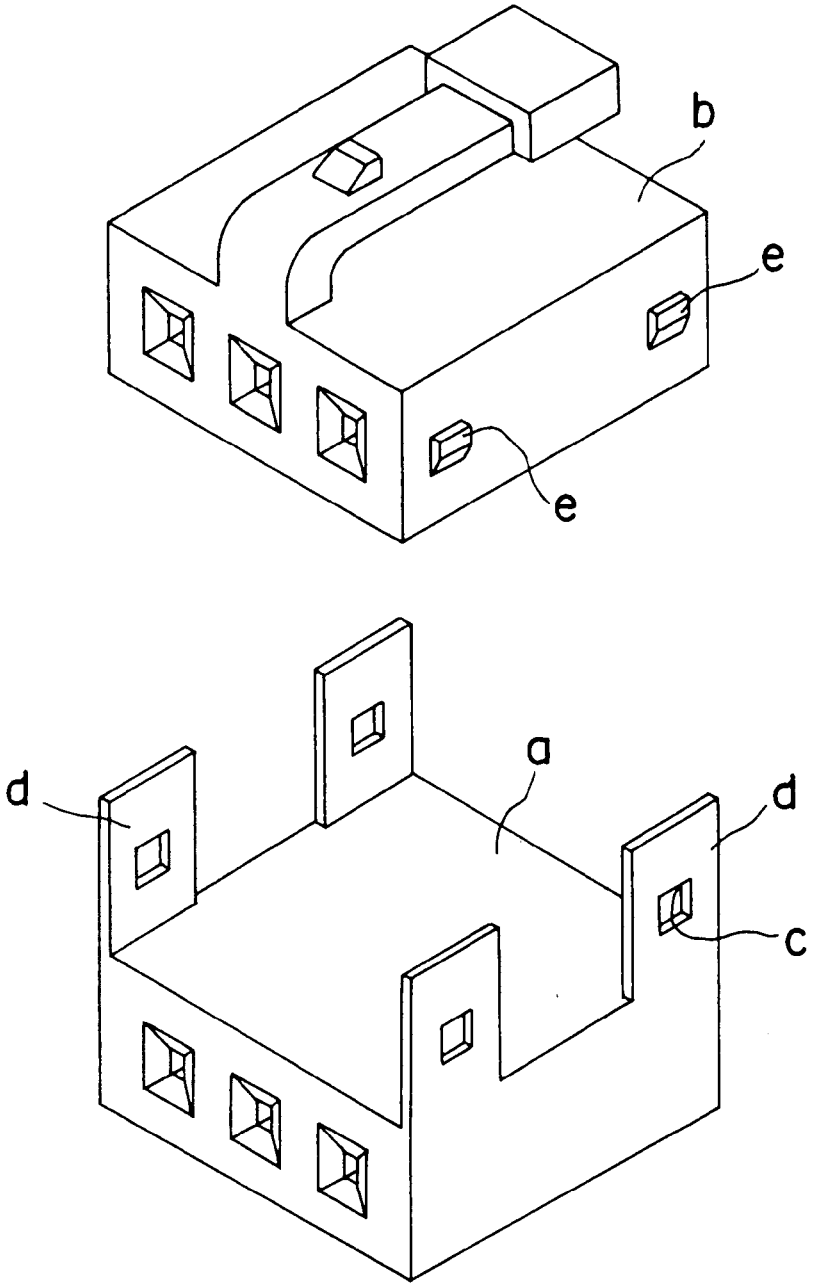
FIG. 7 PRIOR ART
FIG. 7 is a perspective view of a prior art block connector before being assembled.
Figure 8:
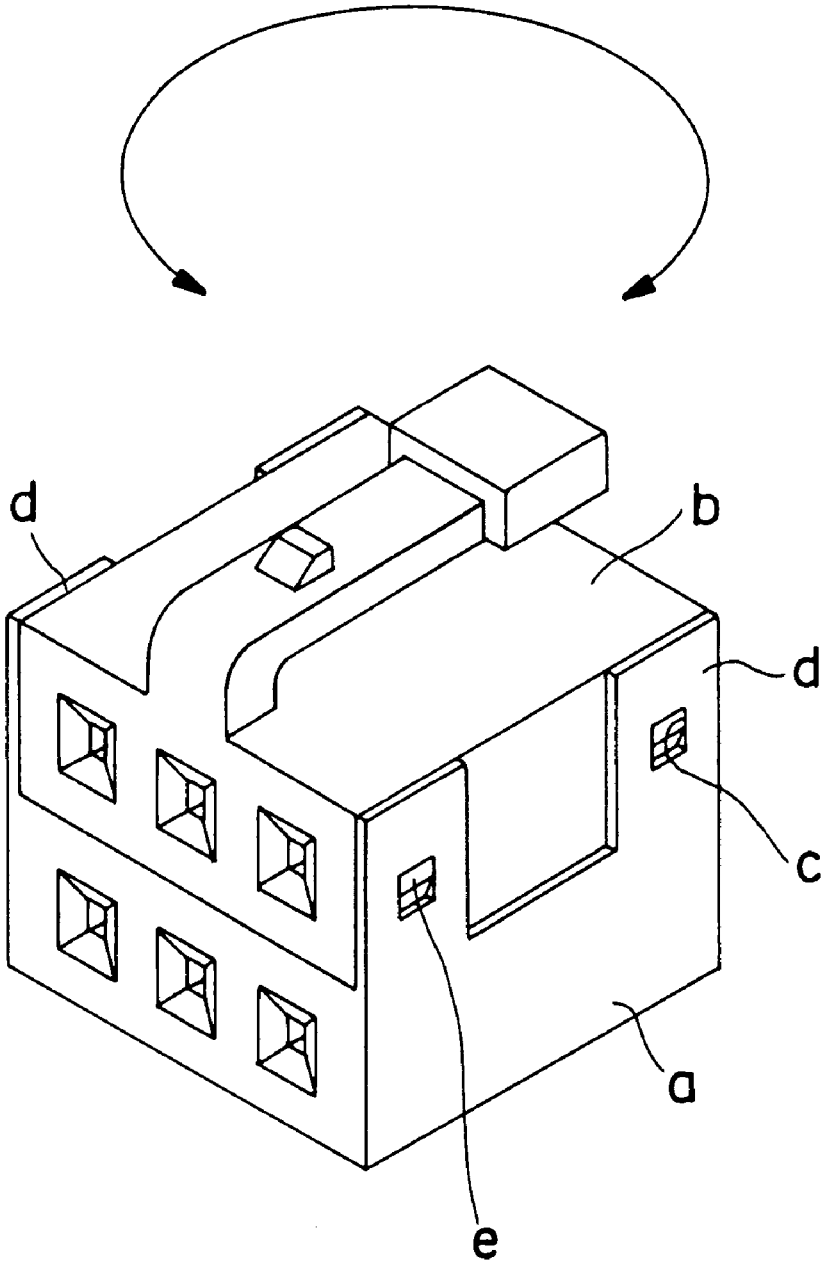
FIG. 8 PRIOR ART
FIG. 8 is a perspective view of the prior art block connector after being assembled.

In a third embodiment shown in FIG. 6, the projections 14 are provided on the lower surface of the upper housing 2, and the round holes 16 into which the projections 14 are fittable are provided in the upper surface of the lower housing 1. As described above, it is sufficient to provide the guide surfaces 15 on either the projections 14 or the round holes 16. The projections 14 and the round holes 16 may be alternately provided in the lower and upper housings 1 and 2.

The present invention is not limited to the described and illustrated embodiments, but the following embodiments are, for example, also embraced by the technical scope thereof as defined in the claims. Besides these embodiments, a variety of changes can be made without departing from the spirit and scope of the present invention as defined in the claims.

In the block connectors in which the projected portions and recesses having a circular cross section are formed as in the foregoing embodiments, the relative rotation of the housings can be securely prevented if the projected portions and recesses are provided in at least two positions.

The projected portions and recesses may have a shape of a cone, tetrahedron, prism or the like. Particularly, with a noncircular cross section, the relative rotation of the housings can be prevented by providing the projected portion and recess in only one position.

The present invention also is applicable to block connectors in which three or more housings are placed one over another.

The present invention also is applicable to block connectors in which housings are assembled by being placed side by side and block connectors in which housings are assembled by being placed one over and another as well as side by side.

The present invention is also applicable to male block connectors.

Furthermore, when at least two projections 14 and mating holes 16 are provided, the at least two projections may have a different shape (e.g. a different diameter or a different geometrical configuration). Of course, the mating holes 16 may have the corresponding complementary shape. Accordingly a rotationally inverted assembling or positioning of the connector housings 1 and 2 is inhibited.

Furthermore, the projections and holes may be arranged at positions not rotationally inverted with respect to one another, i.e. not symmetrically arranged with respect to an axis of rotation substantially normal to the connector housing, such that an inversion or change of orientation of the connector housings is prohibited.

What is claimed is:

1. A block connector having at least two connector housings formed respectively with substantially rectangular engagement surfaces for placement substantially one over another, said engagement surfaces each having parallel front and rear edges and parallel side edges extending perpendicularly between the front and rear edges such that four corners are defined on each said engagement surface, said four corners on each said engagement surface defining pairs of diagonally opposite corners, lock portions provided on at least one of the connector housings for placement over lock portions on the other of the connector housings, at least two projected portions formed on one said engagement surface and disposed respectively in proximity to the corners of one said pair of diagonally opposite corners, and at least two mating recesses disposed on the engagement surface of the other of said connector housings, the mating recesses being disposed in proximity to the corners defining one said pair of diagonally opposite corners such that the projected portions and the mating recesses respectively are engageable with each other.

2. A block connector according to claim 1, wherein at least one of the projected portion and the recess in each pair of engageable projected portions and recesses is provided with a guide portion for guiding the engagement of each said projected portion and the corresponding recess.

3. A block connector according to claim 1, wherein the projected portions and the recesses are disposed and dimensioned for engaging prior to the locking by the lock portions.

4. A block connector according to claim 1, wherein the projected portions and the recesses are formed to have a noncircular cross section.

5. A block connector according to claim 1, wherein the lock portions elastically lock the connector housings, the lock portions being unitarily formed on at least one of the connector housings.

6. A block connector according to claim 1, wherein there are provided at least two projected portions having different shapes from each other.

7. A block connector according to claim 1, wherein at least two projected portions are provided in positions which are not rotationally symmetrical.

8. A block connector according to claim 1 comprising three said projected portions disposed respectively in three of said corners of one said engagement surface and three mating recesses disposed respectively in three of said corners of the other of said engagement surface.

9. A block connector according to claim 1 comprising four said projected portions disposed respectively in four of said corners of one said engagement surface and three mating recesses disposed respectively in four of said corners of the other of said engagement surface.

10. A block connector according to claim 1, wherein each said connector housing includes a plurality of terminal-receiving cavities extending therethrough, the mating recesses being disposed and dimensioned to be spaced from the terminal receiving cavities.

11. A block connector according to claim 1, wherein each said connector housing includes a plurality of cavities for accommodating terminal fittings, the mating recesses being formed in the connector housing at locations such that the respective projected portions engaged in the mating recesses will be spaced from the terminal fittings in the respective cavities.

12. A block connector having at least two connector housings formed respectively with engagement surfaces for placement substantially one over another, each said connector housing having a plurality of cavities passing therethrough, each cavity being configured for receiving a terminal fitting therein, lock portions provided on at least one of the connector housings for placement over lock portions on the other of the connector housings, a plurality of projected portions and a corresponding plurality of mating recesses provided respectively on the engagement surfaces of the connector housings, the projected portions and the mating recesses being disposed at locations for engagement with one another when the engagement surfaces are in opposed abutting engagement with one another, the projected portions and the mating recesses further being disposed at locations on the connector housings such that the projected portions are substantially spaced from the terminal fittings inserted into the cavities of the respective connector housings.

* * * * *